United States Patent [19]

Lindblad et al.

[11] 3,973,845

[45] Aug. 10, 1976

[54] METHOD OF REDUCING FRICTION IN BLADE CLEANING OF IMAGING SURFACES

[75] Inventors: Nero R. Lindblad, Palmyra; Henry R. Till, Rochester; Charles L. Beatty, Brighton, all of N.Y.

[73] Assignee: Xerox Corporation, Stamford, Conn.

[22] Filed: Jan. 15, 1975

[21] Appl. No.: 541,350

[52] U.S. Cl. ..... 355/15; 15/236 R; 15/256.5; 15/256.51; 134/6; 134/7

[51] Int. Cl.[2] ..... G03G 21/00

[58] Field of Search ..... 134/6, 7; 355/15; 15/256.51, 256.5, 256.53, 236 R, 250.36, 250.4

[56] References Cited

UNITED STATES PATENTS

| | | | |
|---|---|---|---|
| 3,080,596 | 3/1963 | Symbolik | 15/250.36 |
| 3,552,850 | 1/1971 | Royka et al. | 355/15 |
| 3,660,863 | 5/1972 | Gerbasi | 355/15 X |
| 3,728,016 | 4/1973 | Harbour et al. | 355/15 |
| 3,764,310 | 10/1973 | Hagenbach | 65/21 X |
| 3,848,993 | 11/1974 | Hasiotis | 355/15 |
| 3,936,183 | 2/1976 | Sadamatsu | 355/15 |

*Primary Examiner*—S. Leon Bashore
*Assistant Examiner*—Marc L. Caroff

[57] ABSTRACT

A cleaning blade is provided for cleaning residual toner particles and other contaminants from an electrostatic imaging surface comprising a surface having rigid spherical protuberances adapted to be pressed against the imaging surface to form a seal between the blade and imaging surface which retards flow of particles between the blade and imaging surface.

5 Claims, 5 Drawing Figures

FIG. 1
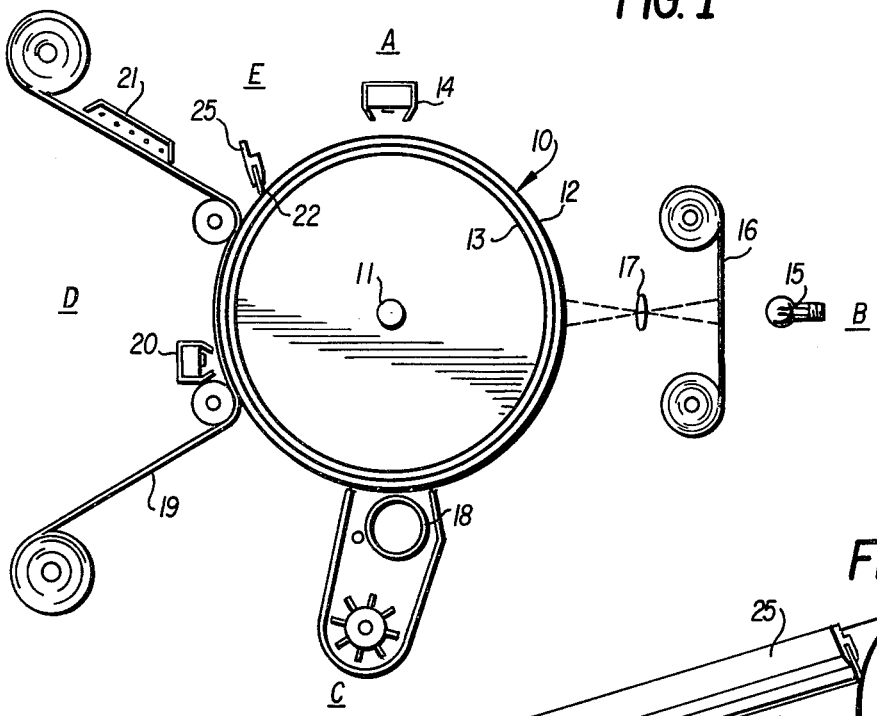
FIG. 2
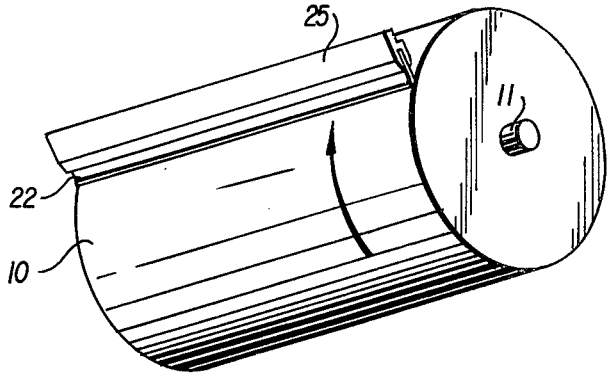
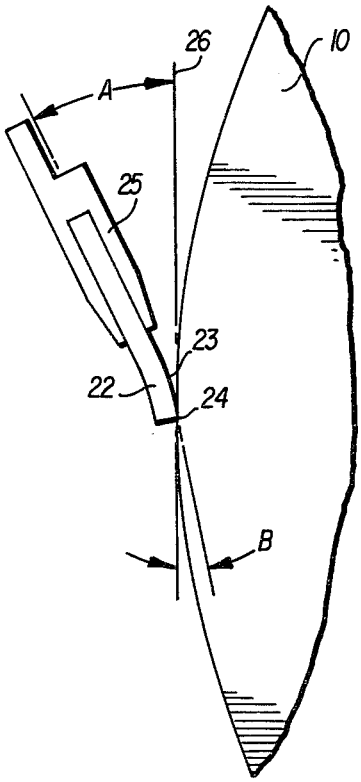
FIG. 3
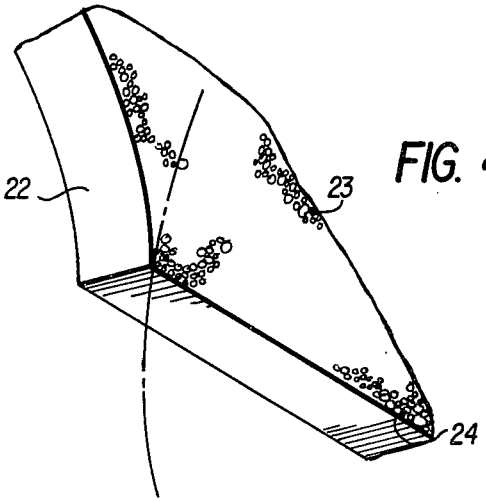
FIG. 4

METHOD OF REDUCING FRICTION IN BLADE CLEANING OF IMAGING SURFACES

This invention relates generally to xerography and more particularly to an improved means for removing residual toner and other contaminants from electrostatic imaging surfaces.

In the art of xerography wherein an image is formed and developed on a surface by electrostatic means as originally disclosed by Carlson in U.S. Pat. No. 2,297,691, a uniform electrostatic charge is placed on a photoconductive insulating layer, the insulating layer is exposed to a light and shadow image to dissipate the charge on the areas of the layer exposed to the light and the resulting latent electrostatic image is developed by depositing on the image a finely divided developer material containing a toner. The toner is attracted to those areas of the photoconductive layer which retain a charge of opposite polarity to form a toner image which corresponds to the latent image. The toner image is later transferred to a support material such as a sheet of paper or the like and affixed to the surface of the sheet by fusion or the like of the toner material.

In such a reproduction process, some residual toner remains on the photoconductive insulating layer after the toner image has been transferred to the support sheet. This residual toner adheres firmly to the surface and must be removed prior to the next exposure to avoid its interference with the development of a new latent image.

Various methods and apparatus for removing the residual toner image have been proposed, such as, for example, the brush and web cleaning devices disclosed in U.S. Pat. Nos. 2,832,977; 3,682,689; 2,911,330 and 3,186,838. Blade type cleaning devices have also been proposed such as, for example, those disclosed in U.S. Pat. Nos. 3,438,706; 3,552,850; 3,634,077; 3,660,863; 3,724,019; 3,724,020; 3,740,789; 3,843,407 and 3,656,200. The blade cleaning device is disposed with an edge closely associated with the surface of the photoconductor drum as the latter rotates so that the residual toner image on the surface of the photoconductive insulating layer is scraped therefrom. One of the problems encountered with these prior art blades is that toner particles slide under the blade. Attempts have been made to avoid this by increasing the pressure of the blade on the surface and to use a lubricant to decrease the friction between the blade edge and drum surface. Neither of these attempts to solve the problem has been entirely successful. Special shims and blade designs are required to permit pressures which result in a significant improvement in toner removal and the use of lubricants introduces problems in keeping the surface of the blade and surface of the drum sufficiently clean to avoid toner accumulation around the blade and carry over of toner beyond the cleaning station.

It is an object of this invention to provide an improved means for removing residual toner and other contaminants from a photoconductive insulating layer after a developed latent image has been transferred therefrom. Another object of the invention is to provide an improved blade cleaning device for an electrostatic imaging system. A more specific object of the invention is to provide a method and apparatus for cleaning an electrostatic imaging surface without the necessity of using a lubricant or cleaning fluid and at practical pressure levels.

Other objects will become apparent from the following description with reference to the accompanying drawing wherein FIG. 1 is a diagrammatic section of a xerographic reproducing machine provided with an embodiment of the cleaning device of this invention;

FIG. 2 is a diagrammatic perspective view of one embodiment of a blade cleaning device associated with a rotatable photoreceptor drum;

FIG. 3 is a fragmentary end view of the embodiment of FIG. 2 illustrating the positioning of the cleaning device with the surface of the photoreceptor drum;

FIG. 4 is an enlarged fragmentary view of the underside of the cleaning blade as it would appear when pressed against the surface of the photoreceptor drum.

Figure 5:
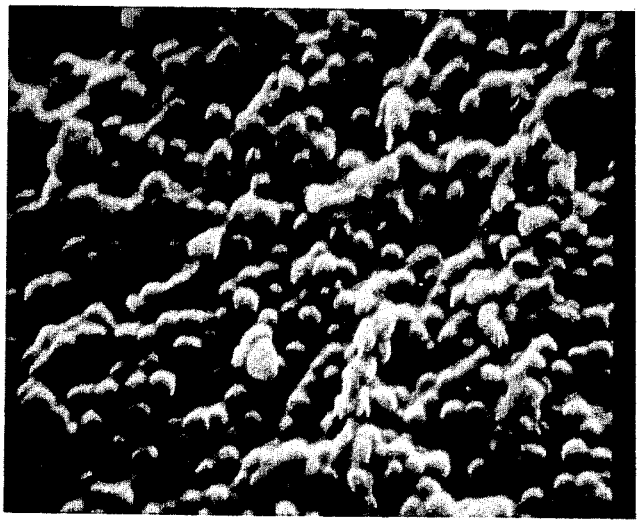
FIG. 5 is a microphotograph of the surface of the cleaning blade contacting the surface of the photoreceptor drum.

The foregoing objects and others are accomplished in accordance with this invention, generally speaking, by providing a method and apparatus for cleaning the surface of a photoreceptor drum of an electrostatic imaging machine with a blade cleaning device having a working surface formed of minute substantially spherical protuberances secured to the blade and adapted to provide a seal between the blade and an imaging surface which prevents toner particles and other contaminants from becoming trapped between the blade and imaging surface and from sliding under the blade as the imaging surface passes under the blade.

In a preferred embodiment of the invention substantially spherical particles are secured to or embedded in the cleaning blade to provide a surface substantially covered with segments of spheres protruding from the blade surface. The sphere segments are disposed adjacent to the edge of the blade which serves as a scraper as the photoreceptor drum rotates in a position where they form a seal between the drum surface and blade. Spherical segments of substantially uniform diameter are preferred. The diameter of the spheres should be smaller than the cross-section of the toner particles, generally 0.5 micron or less, to insure that even the smallest particles adhering to the imaging surface are contacted by a sphere and scraped from the surface. A surface coated with such small spheres will also prevent toner particles from becoming wedged between the blade and drum surface or from passing beyond the drum cleaning station. The cleaning blade provided by the invention acts as a knife or chisel and scrapes residual toner particles from the electrostatic imaging surface without requiring blade pressures against the drum which might cause blade breakage, or scratching of the imaging surface and without sufficient friction between the blade and drum to require the use of a lubricant.

Referring now to FIG. 1 of the drawing, a photoreceptor drum 10 rotated by a shaft 11 rotates from station A, a charging station, to station B, an exposure station, to station C, a developer station, to station D, a transfer station and finally to station E, a cleaning station, in making a xerographic copy of an original document. A photoconducting insulating layer 12 of vitrous selenium or the like is deposited on a conductive backing 13 of drum 10.

At station A, an electrostatic charge is placed on the photoconductive insulating layer 12 with a charging device 14 such as a corona charging device.

At station B, the charged surface is exposed to a light source 15 through an original document 16 to be copied and a lens 17 to form a latent image of the document.

The latent image is developed with powdered toner at station C. Developer mixture of toner and magnetic carrier material attracted to magnetic roller 18 is rotated into close proximity with the latent image on the photoconductive plate of drum 10 where toner particles are attracted from the mixture to the latent electrostatic image.

Drum 10 with its developed latent image rotates to station D where the toner particles are attracted from the latent image to a web of paper 19. Corona device 20 effects the electrostatic transfer from drum 10 to paper 19. A fusing element 21 fixes the transferred image to paper 19.

After transfer of the developed image to the paper web 19, drum 10 rotates to the cleaning station E where cleaning blade 22 removes residual toner from the surface of drum 10 before it returns to charging station A.

Referring now to FIGS. 2 and 3 of the drawing, a substantially non-porous elastomeric polyurethane blade 22 has its surface 23 adjacent to leading and scraping edges 24 substantially covered by substantially spherically shaped protuberances pressed against the surface of the drum 10. As illustrated in the drawing the relatively thin blade 22 flexes or bends slightly under the pressure and the portion 23 of the underside of the blade 22 immediately adjacent to edge 24 is in contact with the surface of drum 10. The friction between the irregular surface of blade 22 and the photoreceptor drum 10 is less than it would be with a smooth flat surface. Since the diameter of the spherical segments and the spacing between protuberances is less than the cross-section of the toner particles, however, the toner particles are scraped from the surface of the drum and remain on the upstream side of the cleaning blade 22 in the path of rotation of drum 10.

In a preferred embodiment of the invention, a blade holder 25 supports blade 22 and is adjusted so that the blade edge 24 is pressed against the surface of the drum 10 under an applied load of about 13.4 gm/cm. At this pressure, blade 22 bends along edge 24 as illustrated in FIGS. 2 and 3. With an angle A between the tangent 26 to the surface of drum 10 and the axis of blade 22, of about 23°, the angle B between the underside 23 of blade 22 adjacent to edge 24 and the surface of drum 10 is about 12°, the preferred working angle. The surface 23 of blade 22 is illustrated in FIG. 5, a microphotograph of one embodiment of the invention where solid polystyrene spheres were pressed into the surface 23 of a poly(vinylacetate-ethylene) copolymer blade.

Blade 22 may be shaped from any suitable flexible elastomeric or plastic material including those disclosed in the above listed patents. It may be molded or cut natural or synthetic rubber, non-porous polyurethane elastomer, poly(vinylacetate-ethylene) copolymer or the like. The hardness of the blade should preferably be from about 60 to about 70 Shore A.

The substantially spherical protuberances may be secured to or embedded along the adjacent trailing side of edge 24. The exposed segments of the spheres should be sufficiently hard to resist deformation when pressed against the surface of the drum 10 but not so hard that they scratch the imaging surface. They should extend along at least that portion of the length of the blade 22 which will contact the drum surface when the blade is pressed thereagainst. The width of the band of protuberances on the underside 23 of the blade 22 need not be larger than the width of the contacting surface of the blade 22 when the blade is pressed against the surface of the drum 10 to include an angle of about 12° between the tangent to the drum surface and the axis of the blade. Any suitable pressure may be applied to the blade to hold it in contact with the imaging surface. A normal pressure is about 10 to 20 gm/cm.

The spherical members used for the protuberances may be formed from any suitable plastic, ceramic material, elastomer or the like which can be formed into rigid substantially spherical particles which have a diameter of less than about one-half of the diameter of the toner particles used to develop the image and which is sufficiently hard to resist deformation when the spheres are pressed against the surface to be cleaned. Usually, with most commercially available toner particles, the diameter of the spheres should be about 0.5 micron or less. Any suitable semi-crystalline, glassy polymer such as a polycarbonate, polystyrene, polyethylene, polypropylene, polyvinylidene chloride, polytetrafluorethylene, polyamide, nitrile rubber, silicone rubber or the like may be used for making the spherical particles. The particles may be formed by any known process such as emulsion polymerization. The spherical particles may be secured to the surface of the blade by pressing the spheres against the surface of the blade while it is softened or by sticking the spheres to the surface of the blade with an adhesive.

Although the invention is described in detail for the purpose of illustration it is to be understood that such detail is solely for that purpose and that variations can be made therein by those skilled in the art without departing from the spirit and scope of the invention except as it may be limited by the claims.

What we claim is:

1. In an apparatus for removing toner from a moving imaging surface comprising:

an imaging surface arranged for movement;

blade means which does not require the use of a lubricant for removing toner from said imaging surface, said blade means having a blade surface defining an edge; and means for supporting said blade means with said edge pressed against said imaging surface for removing said toner;

the improvement wherein, said apparatus further includes:

means for providing a seal between said blade edge and said imaging surface for preventing toner from passing said blade and for reducing friction between said blade and said imaging surface, said seal means comprising substantially spherical particles which are sufficiently rigid to resist deformation when pressed against said imaging surface, said particles being embedded in said blade to substantially cover said edge with segments of said particles protruding from said blade surface.

2. An apparatus as in claim 1, wherein said toner comprises particles and wherein said seal means particles have a diameter of less than about one-half the diameter of said toner particles.

3. An apparatus as in claim 2, wherein said spherical particles are about 0.5 microns or less in diameter.

4. An apparatus as in claim 1, wherein said particles are formed of a material selected from the group consisting of plastics and ceramics.

5. An apparatus as in claim 4, wherein said spherical particles are selected from the group consisting of polycarbonate, polystyrene, polyethylene, polypropolene, polyvinylidene chloride, polytetrafluoroethylene, polyamide, nitrile rubber, and silicone rubber.

* * * * *